United States Patent [19]

Stoveken

[11] 4,257,294

[45] Mar. 24, 1981

[54] APPARATUS FOR SEVERING SHEET MATERIAL

[75] Inventor: F. Raymond Stoveken, East Windsor, N.J.

[73] Assignee: Marcal Paper Mills, Inc., Elmwood Park, N.J.

[21] Appl. No.: 973,883

[22] Filed: Dec. 28, 1978

[51] Int. Cl.[3] ..... B26D 1/02; B26D 1/20; B26D 7/04

[52] U.S. Cl. ..... 83/374; 83/455; 83/485; 83/508; 83/582; 83/651.1

[58] Field of Search ..... 83/455, 485, 614, 508, 83/651.1, 374, 582

[56] References Cited

U.S. PATENT DOCUMENTS

| | | | |
|---|---|---|---|
| 879,153 | 2/1908 | Dirr et al. | 83/485 |
| 2,599,601 | 6/1952 | Axworthy | 83/485 |
| 3,137,192 | 6/1964 | McNeil | 83/455 |
| 3,447,409 | 6/1969 | Lewis | 83/485 |
| 3,890,868 | 6/1975 | Pickler | 83/485 X |
| 3,981,215 | 9/1976 | Granger et al. | 83/455 |

*Primary Examiner*—Frank T. Yost
*Attorney, Agent, or Firm*—Burns, Doane, Swecker & Mathis

[57] ABSTRACT

Apparatus for severing sheet material by a cutter device that is mounted upon a rail assembly for reciprocating movement. The rail assembly includes a channel member with an outwardly extending guide rail. A separate cutter bar is supported on the guide rail and extends longitudinally above the guide rail. A carriage is mounted on the guide rail for reciprocating movement and includes dual rollers which engage opposite sides of the cutter bar. The carriage is held against the guide rail by a pressure roller which engages the inner side of the guide rail. The pressure roller includes an adjustable mounting arrangement for adjusting the force that clamps the carriage against the guide rail. One of the dual rollers has a dull edge which engages the cutter bar while the other dual roller has a sharp edge to sever the paper or other sheet material as the carriage moves longitudinally of the cutter bar.

8 Claims, 6 Drawing Figures

APPARATUS FOR SEVERING SHEET MATERIAL

BACKGROUND OF THE INVENTION

This invention relates to severing apparatus, and particularly to apparatus for severing sheet material including paper, textiles, non-wovens, foils, foams and plastic materials.

Various devices such as knives, scissors, shears and other devices which use sharp cutting edges have been used to sever the paper or other sheet material. These sharp cutting edges are hazardous to the user. Over a long period of time the edges become dull and must be sharpened. In factories, it is often desireable to employ various severing devices to cut sheet material into convenient size from a dispensing roll. The severing device must protect the worker from the risk of being cut or injured, and yet must operate easily and quickly. Devices of this kind have been utilized previously. Typically, such cutting devices include a carriage on which is mounted a cutter wheel which cooperates with a cutter bar to shear the sheet material as the wheel moves along the cutter bar. Other devices include cutter blades mounted in a carriage so that as the carriage moves across the sheet of paper, the paper is sheared by the blades. While these devices have the general advantage of being relatively safe to operate, they have the disadvantage of requiring sharpening of the cutter bar or the cutter wheel. Another disadvantage is that the sheet material tends to bend over the cutter and to pass between the bar and the wheel without being sheared. This is particularly a problem when the sheet material is stronger than paper, such as textiles, non-wovens or plastic material.

In view of these disadvantages of prior art apparatus, it is an object of this invention to provide an apparatus for severing sheet material which is capable of efficiently and effectively severing not only paper, but also other sheet material including textiles, foils, foams, rubbers, non-wovens and plastics, and composite materials.

It is a further object of this invention to provide apparatus for severing sheet material which protects the users from possible injury and which minimizes wear of the components.

SUMMARY OF THE INVENTION

The apparatus for severing sheet material in accordance with this invention includes a rail assembly on which a reciprocating carriage is supported. The rail assembly includes a cutter bar, preferably having opposed flat sloping surfaces to cooperate with dual rollers on the carriage. One of the dual rollers has a dull edge to engage one flat side of the cutter bar while the other roller has a sharp edge to engage the opposite flat side of the cutter bar. A pressure roller assembly on the carriage urges the dual rollers against the cutter bar while the carriage reciprocates along the rail assembly. Sheet material placed over the cutter bar is severed by the carriage assembly as the dual rollers engage the sheet material.

DESCRIPTION OF THE DRAWINGS

A preferred embodiment of the invention is illustrated in the accompanying drawings in which.

DESCRIPTION OF THE PREFERRED EMBODIMENT

Figure 1:
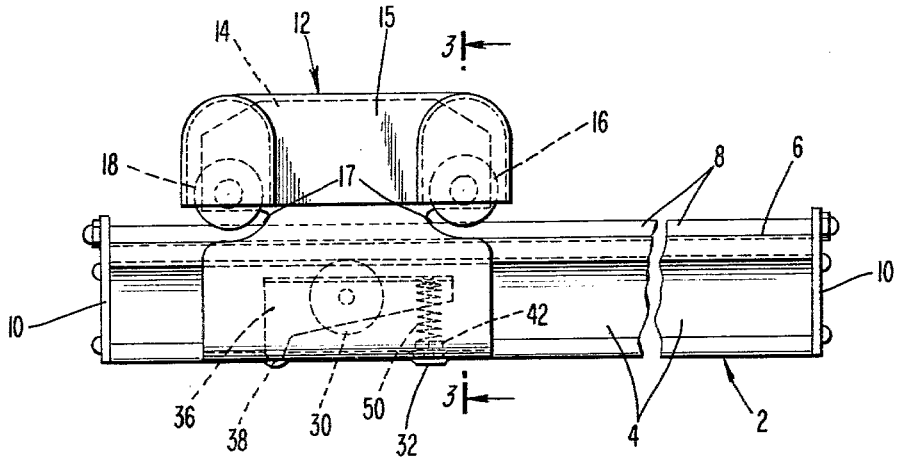
FIG. 1 is a side elevational view of the apparatus for severing sheet material in accordance with this invention.

The apparatus for severing sheet material in accordance with this invention includes a rail assembly 2 which comprises a channel member 4 for which may preferably be formed of extruded aluminum or other suitable material. The channel member 4 includes a cantilever guide rail 6 which is exposed on its upper and lower sides. A cutter bar 8 is mounted on the upper side of the rail 6. Each end of the rail assembly includes end plates 10 which may be secured to suitable support means for holding the rail assembly in place while the severing apparatus is being used.

Figure 3:
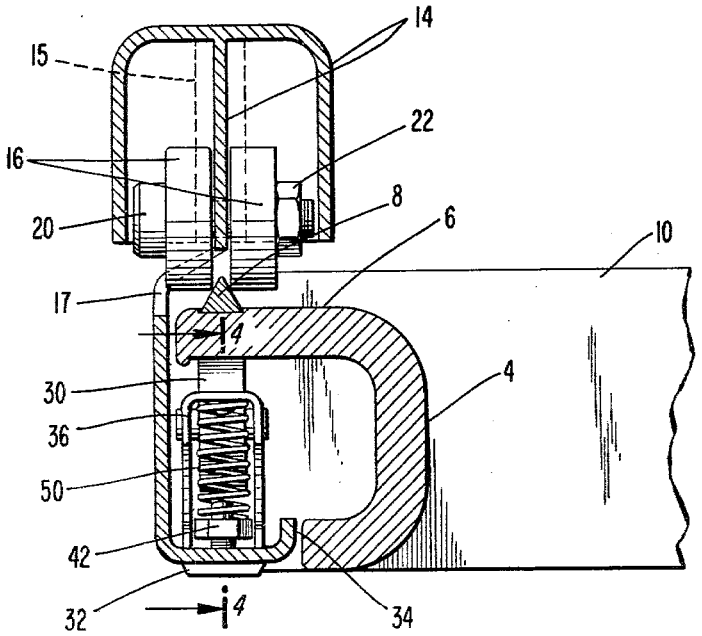
FIG. 3 is a cross-sectional view of the apparatus along the line 3—3 in FIG. 1.

A carriage 12 is mounted on the rail assembly for reciprocating movement along the cutter bar 8. The carriage 12 includes a frame 14, which is preferably formed of sheet material or extruded. At each end of the carriage, a dual set of rollers 16 and 18 is provided. As shown in FIG. 3, the dual set of rollers 16 includes a screw 20 which serves as a shaft for rotation of the rollers and a nut 22 which retains the rollers on the screw. The screw passes through a hole in the frame 14 which serves as a journal bearing for the rollers 16. The dual set of rollers 18 is mounted in exactly the same manner as the set of rollers 16. A cover 15 extends over both of the rollers 16, 18 and over the center portion of the frame 14 to protect the operator and to serve as a handle.

Figure 2:
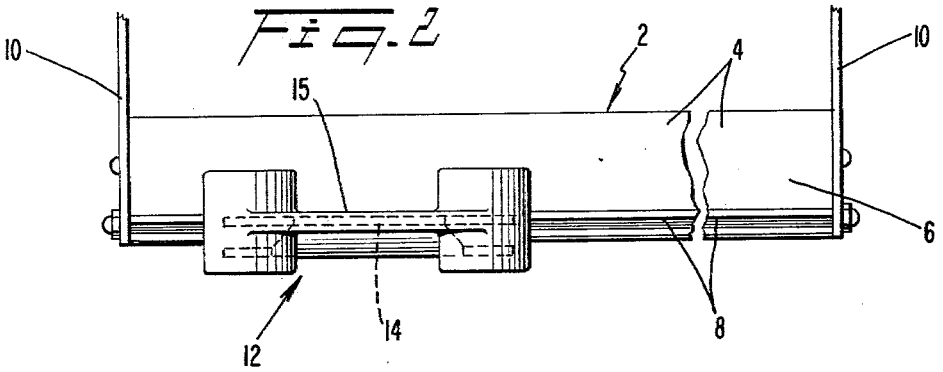
FIG. 2 is a top plan view of the apparatus of this invention.
Figure 5:
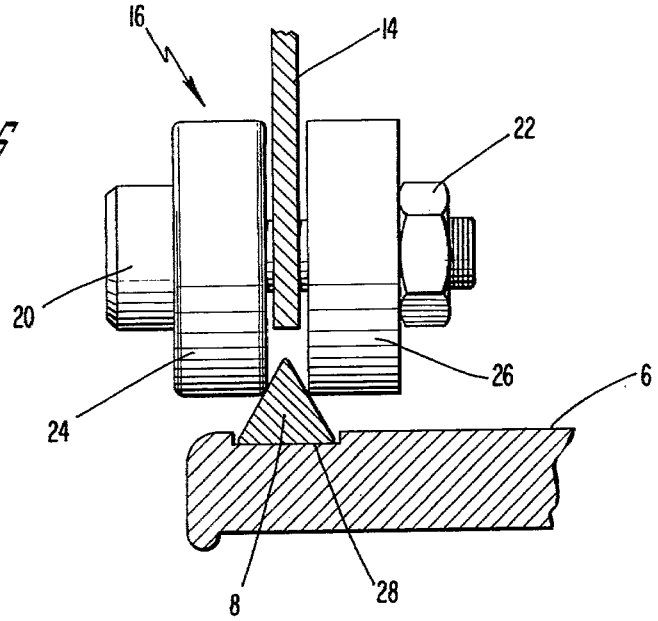
FIG. 5 is an enlarged detail view, partially in cross-section, showing the dual rollers and cutter bar.

Referring to FIG. 5, it can be seen that the inner edges of the rollers 24, 26 of the set of rollers 16 engage opposite sides of the cutter bar 8. The cutter bar preferably has the cross-sectional shape of a triangle, with an included angle of about 90° between the rollers. The slope of each side of the cutter bar relative to the axis of the rollers 24 and 26 should be the same. The roller 24 has a rounded edge which engages the side of the cutter bar 8, while the roller 26 has a sharp edge which engages the cutter bar. The roller 24 serves as a guide roller for the cutter roller 26. The cutter bar 8 is received in a groove 28 formed in the rail 6 to prevent lateral displacement, and the ends of the cutter bar are secured in the end plate, as shown in FIGS. 1 and 2. In order to avoid tearing the paper or other sheet material during the cutting operation, the corners of the cutter bar 8 should be rounded, rather than sharp.

Figure 6:
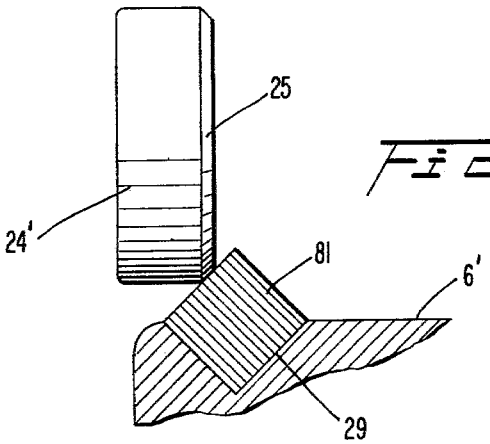
FIG. 6 is an enlarged detail view as in FIG. 5, but showing a modified form of the rail and roller components.

As an alternative to the triangular cutter bar 8, other shapes having flat opposed sides may be suitable. For example, a cutter bar 8' having a square cross-section as shown in FIG. 6 can be substituted for the triangular cutter bar 8. A corresponding V shaped groove 29 is provided in the rail 6' to receive the bar 8'. The width of the sides of the cutter bar should be equal, so that in the event of wear of the cutter bar, the bar can be rotated to expose a fresh side. The material of which the roller 26 is made should be at least as hard as the material of the cutter bar 8, and preferably should be harder. It has been found that the roller 26 can be made from mild steel having a hardness of about 60 Rockwell C and the cutter bar 8 can be made from mild steel having a hardness of about 50 Rockwell C. As an alternative, the guide roller 24' may have a flat chamfer 25 as shown in FIG. 6 to reduce marking of the material being severed.

Figure 4:
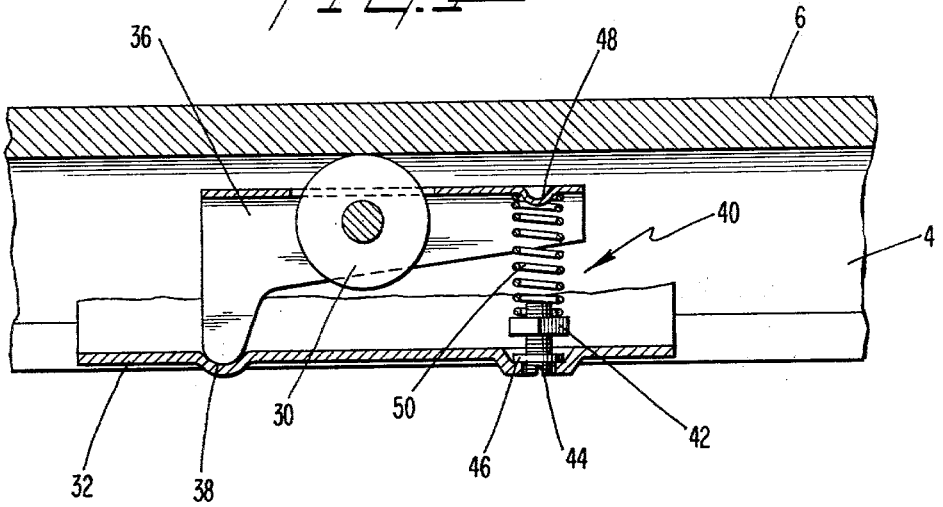
FIG. 4 is a cross-sectional view along the line 4—4 in FIG. 3.

The dual sets of rollers are urged against the cutter bar 8 by a pressure roller 30. As shown in FIG. 4, the frame 14 extends over the guide rail 6 and includes a flange 32 which is spaced below the guide rail. The flange 32 of the frame 14 includes an edge portion 34 which is spaced from the lower edge of the channel member 4. The pressure roller 30 is journaled in a lever arm 36 which is pivotably mounted at one end in a socket 38 formed in the flange 32. At the opposite end of the lever arm 36, a spring assembly 40 is provided to urge the pressure roller 30 to bear against the lower side of the rail 6. The assembly 40 includes a nut 42 which is gripped between the edge portion 34 and the side of the frame 14 (FIG. 3) and is supported on the inside of the flange 32. An adjustment screw 44 is threaded through the nut 42. The screw 44 preferably has an Allen wrench socket at its lower end. A traverse pin 46 passes through the screw 44 and bears against the flange 32. The lever arm 36 has a dimple 48 opposite the screw 44. A compression spring 50 is seated at one end around the dimple 48 and at the other end over the screw 44 so that the end bears against the nut 42. By turning the screw 44, the pressure of the roller 30 against the rail 6 can be adjusted to accomodate various material characteristics.

The portion of the carriage frame 14 that is adjacent to the rail 6 preferably is positioned close to the rail and to the cutting path of the rollers, so that the frame does not interfere with the severing operations. As shown in FIG. 1, the frame 14 is tapered toward the edges 17 of the frame in the area adjacent the cutter bar 8. The tapered surface of the frame is on the outer side (the side viewed in FIG. 1) to guide the severed material around the frame without tearing.

The carriage may be installed on the rail assembly 4 by removing the end plate 10 at the right end of the rail 6, as viewed in FIG. 1. The carriage is then placed over the end of the guide rail 6 with dual rollers engaging the cutter bar 8 and the pressure roller passing under the guide rail. The spring 50 urges the pressure roller 30 against the lower side of the rail 6. The force of the pressure roller should be adjusted by means of the screw 44 according to the material that is to be cut. The end plate is then replaced.

The carriage is positioned at one end of the rail assembly 2 and the sheet material is placed over the guide rail 6, so that it extends across the cutter bar 8. The carriage is then advanced along the rail 6. As the first set of rollers engages the sheet material, the guide roller 24 clamps the material in place, while the cutter roller 26 cooperates with the cutter bar 6 to sever the material. The carriage is capable of cutting the material while moving in either direction along the cutter bar, since another set of rollers 18, which is essentially identical with the first set of rollers permits cutting during the return stroke. The cutting apparatus of this invention may be mounted directly on a support for a roll of sheet material, so that the sheet material may be cut into suitable lengths as it is dispensed from the roll.

The mounting arrangement of the carriage on the guide rail allows the cutting device to be made in any convenient length without deflection of the component and without causing the cutters to become inoperative, as occurs with certain prior art devices. This apparatus is efficient because it is capable of severing the material while moving in either direction along the cutter bar. Also it is capable of cutting thick or bulky materials which can not be cut effectively with devices using knife blades. The efficient arrangement of the carriage and guide rail permits the application of a power device, to drive the carriage in both directions.

While this invention has been illustrative and described in accordance with a preferred embodiment, it is recognized that variations and changes may be made without departing from the invention as set forth in the claims.

What is claimed is:

1. Apparatus for severing sheet material comprising guide rail means, carriage means including means mounting said carriage means on said guide rail means, a cutter bar supported on said guide rail means, said cutter bar having opposite flat surfaces extending longitudinally of said rail means, said carriage means including a dual set of rollers, one of said rollers having a sharp edge in engagement with said flat surface of said cutter bar and the other of said dual rollers having an edge in engagement with an opposed flat face of said cutter bar, a pressure roller on said carriage means engaging said rail means to clamp said dual set of rollers against said cutter bar while allowing said carriage means to advance longitudinally along said rail means, said carriage means including a frame, said frame including a flange overlapping said rail means, and a lever arm on said carriage means between said flange and said rail means, said pressure roller being mounted on said lever arm, and adjustment means between said lever arm and said flange for adjusting the position of said pressure roller relative to said dual rollers.

2. The apparatus according to claim 1 wherein said rail means includes a channel member having one side projecting outwardly to form a rail, said rail having a longitudinal groove therein and said cutter bar being received and secured in said groove.

3. The apparatus according to claim 2 wherein said cutter bar has flat sides of substantially equal width and the slope of each side of the cutter bar relative to the axis of the rollers is the same.

4. The apparatus according to claim 1 wherein said carriage means includes a first set of dual rollers and a second set of dual rollers mounted at opposite ends of said carriage frame, each of said dual sets of rollers engaging said cutter bar for cutting said sheet material upon movement of said carriage means in either longitudinal direction.

5. The apparatus according to claim 1 wherein said carriage means includes said first mentioned dual rollers and a second set of dual rollers, said first and second dual rollers being spaced apart on said frame and each of said rollers engaging said cutter bar, said pressure roller engaging said rail means at a location between said first and second dual rollers.

6. Apparatus for severing sheet material comprising:

(a) guide rail means including a cantilever rail having opposite side surfaces, (b) a carriage mounted on said rail for reciprocating movement along said rail, (c) a cutter bar having opposite flat sides intersecting along an edge of the bar, means mounting said bar on said rail with said edge of said bar projecting outwardly from one of said sides of the rail, (d) said carriage including dual rollers in engagement with said cutter bar, one of said rollers having a sharp edge contacting said flat side and the other of said rollers having a dull edge contacting said opposite flat side of the bar, (e) said carriage including pressure roller means engaging the other of said side surfaces of said rail and urging said dual rollers into engagment with said cutter bar as said carriage is displaced along said rail to sever sheet material, said carriage including a frame, said pressure roller means including a lever pivotally mounted on said frame and a pressure roller supported for rotation on said lever, said pressure roller means further including spring means between said frame and said lever for urging said roller toward said rail.

7. The apparatus according to claim 6 wherein said rail has a longitudinal groove in said one side and said cutter bar is received in said groove.

8. The apparatus according to claim 6 wherein said lever is pivotally supported in a socket in said frame, said spring means being spaced longitudinally of said lever from said socket, and said pressure roller being between said spring means and said socket, said spring means including an adjusting screw for changing the spring bias on said lever.

* * * * *